United States Patent [19]

Beyaert

[11] Patent Number: 4,984,607

[45] Date of Patent: Jan. 15, 1991

[54] DEVICE FOR DRIVING HARNESSES OF WEAVING MACHINES

[75] Inventor: Daniel Beyaert, Wijtschate-Heuvelland, Belgium

[73] Assignee: Picanol N.V., Belgium

[21] Appl. No.: 446,143

[22] Filed: Dec. 5, 1989

[30] Foreign Application Priority Data

Dec. 27, 1988 [BE] Belgium ..... 8801436

[51] Int. Cl.[5] ..... D03C 13/00

[52] U.S. Cl. ..... 139/79; 139/66 R; 74/54

[58] Field of Search ..... 74/53, 54; 139/55.1, 139/76, 74, 66 R, 79

[56] References Cited

U.S. PATENT DOCUMENTS

| | | | |
|---|---|---|---|
| 1,333,191 | 3/1920 | Stonebreaker | 74/53 |
| 3,946,766 | 3/1976 | Amiques | 139/66 R |
| 4,392,350 | 7/1983 | Marks | 74/53 X |
| 4,646,788 | 3/1987 | Brock et al. | 139/66 R X |
| 4,766,935 | 8/1988 | Tanaka et al. | 139/55.1 |
| 4,817,676 | 4/1989 | Hans | 139/66 R |

FOREIGN PATENT DOCUMENTS

| | | |
|---|---|---|
| 2060836 | 5/1972 | Fed. Rep. of Germany . |
| 83754 | 8/1956 | Netherlands . |
| 2018840 | 10/1979 | United Kingdom . |

*Primary Examiner*—Andrew M. Falik

*Attorney, Agent, or Firm*—Bacon & Thomas

[57] ABSTRACT

A device for driving harnesses of weaving machines includes at least two driven cam shafts and at least one pair of conjugated cams connected to each other for each shaft. Swivel mounted levers which swivel about a common shaft are mounted alternately and in an opposite sense in relation to adjacent levers, each lever including two cam followers which operate with one of the conjugated cam pairs to provide a positive cam drive for the lever so that the lever oscillates. A transmission converts the oscillating motion of the levers into an up and down of the harnesses.

7 Claims, 2 Drawing Sheets

DEVICE FOR DRIVING HARNESSES OF WEAVING MACHINES

BACKGROUND OF THE INVENTION

This invention concerns a device for driving harnesses of weaving machines.

It is known that the shedding motion of weaving machines is obtained principally in three ways, namely by means of a cam drive, by means of a dobby or by means of a jacquard mechanism.

A cam drive is mainly used for a plain weave, dobbies are used for more intricate weaves such as checks, in which the harnesses can remain in the same position for a longer period of time, while jacquard mechanisms are used for the so-called jacquard textiles, in which as is known the warp threads are controlled separately. This invention concerns the first kind of drive.

In order to prevent large inertial forces, on high-speed weaving machines it is necessary that the harnesses be constructed as light as possible. It is also necessary for the harnesses to have as short a travel as possible, in other words to keep the amplitude of the up-and- down motion to a minimum. However, it is obvious that the motion of the harnesses depends on the preset opening angle of the shed. The harness situated the furthest from the fell line must carry out the largest motion, while the necessary motion becomes smaller as the harnesses are situated nearer to the fell line. A harness assembly with a large number of harnesses has to be kept as thin as possible, i.e. with the smallest possible distance between successive harnesses.

A known device for driving harnesses consists of levers connected to the harnesses and driven by means of negative cam drives. Such a negative cam drive means in this case that the motion of the levers is controlled in one sense by the cam and that the return motion is obtained by means of a spring which restores the lever to its original position. The use of such a negative cam drive offers the advantage that only one cam and cam follower are necessary per lever, so that in the case where the drives are provided directly underneath the harnesses, the width of the contact area of the cams and cam followers can be chosen to be almost as wide as half the distance between successive harnesses, i.e. half the pitch.

However, the above-mentioned negative cam drives are less suitable for high-speed weaving machines because the springs are not able to keep the cam followers in contact with the cams, unless very heavy constructions are used, which in turn require a large drive torque, even when the machine is running in slow motion.

In order to provide a solution for the above-mentioned disadvantage, devices are known in which the above-mentioned levers are driven by positive cam drives. Such a positive cam drive means that the oscillating movement of the levers is controlled in both senses by cams, so that return springs are no longer used. In such constructions, each lever carries two cam followers each of which operating in conjunction with a cam, known as conjugated cams, or "master and slave".

The use of a positive cam drive in turn causes problems. Indeed, for reasons stated above, it is necessary to keep the distance of the harnesses of high-speed weaving machines as small as possible, for example 12 mm. However, the use of a positive cam drive means that for each lever two cams must be provided next to one another, with the result that, also for structural reasons, the contact area of each cam can only be 3 to 4 mm wide. At very high rotation-speeds of the weaving machine, such contact areas are too narrow to support the strong inertial forces, causing the cams and cam followers to wear very quickly.

In order to solve this problem, it has already been suggested to make the body formed by the drive means wider than the harness assembly and to use bent transmission arms between the cam drives and the harnesses. However, such devices have the disadvantage that they are subjected to strong torsion moments, resulting in all kinds of negative effects. In order to limit wear phenomena, relatively expensive structures are necessary.

On the other hand it is also known to mount the two cams of each pair of cams belonging to one harness on different shafts, so that both cams are situated in one and the same area and both can make use of the entire width available. However, this solution has the disadvantage that many problems arise when setting the play and pretensioning of the conjugated cams, which must be carried out with the greatest precision. Such a construction is therefore not at all suitable for changing the crossing moment of the harnesses by turning the cams on their shafts.

In order to avoid the problem of synchronization of the conjugated cams, it is also known to make use of a negative cam drive, where the cams are mounted alternately on two different shafts. As a result, very wide cams and cam followers can be incorporated, as wide as 1.5 or 2 times the distance between the two harnesses. On the one hand such an embodiment allows a solid construction, yet on the other hand the above-mentioned disadvantage remains, i.e. the construction requires high drive torques, even when the machine is running in slow motion.

SUMMARY OF THE INVENTION

This invention concerns a device for driving harnesses, particularly where use is made of a positive cam drive, which does not cause the above-mentioned disadvantages.

To this end, this device includes of a combination of at least two cam shafts; means to drive the cam shafts; per cam shaft at least one pair of conjugated cams connected to one another; levers which swivel about one common shaft, where each lever is mounted alternately and in the opposite sense in relation to the adjacent lever; per lever two cam followers which operate with one of the above-mentioned cam pairs and thus provide the positive drive of the lever concerned, so that it carries out an oscillating motion; and transmissions which convert the motion of the levers into up-and-down motions of the harnesses.

In a preferred embodiment, the levers are mounted next to one another near their common shaft, while the ends which operate with the cams are constructed so that they make use of almost the double width of the distance between the successive levers.

This offers the advantage that despite the fact that two cam followers are mounted on one lever, the normal width of the lever is maintained and not reduced by half as is the case in known embodiments. Thus wider cams and wider cam followers can be used.

BRIEF DESCRIPTION OF THE DRAWINGS

In order to better explain the characteristics of the invention, the following preferred embodiment is described, by way of example only and without being limitative in any way, with reference to the accompanying drawings, where.

DETAILED DESCRIPTION OF THE PREFERRED EMBODIMENTS

Figure 1:
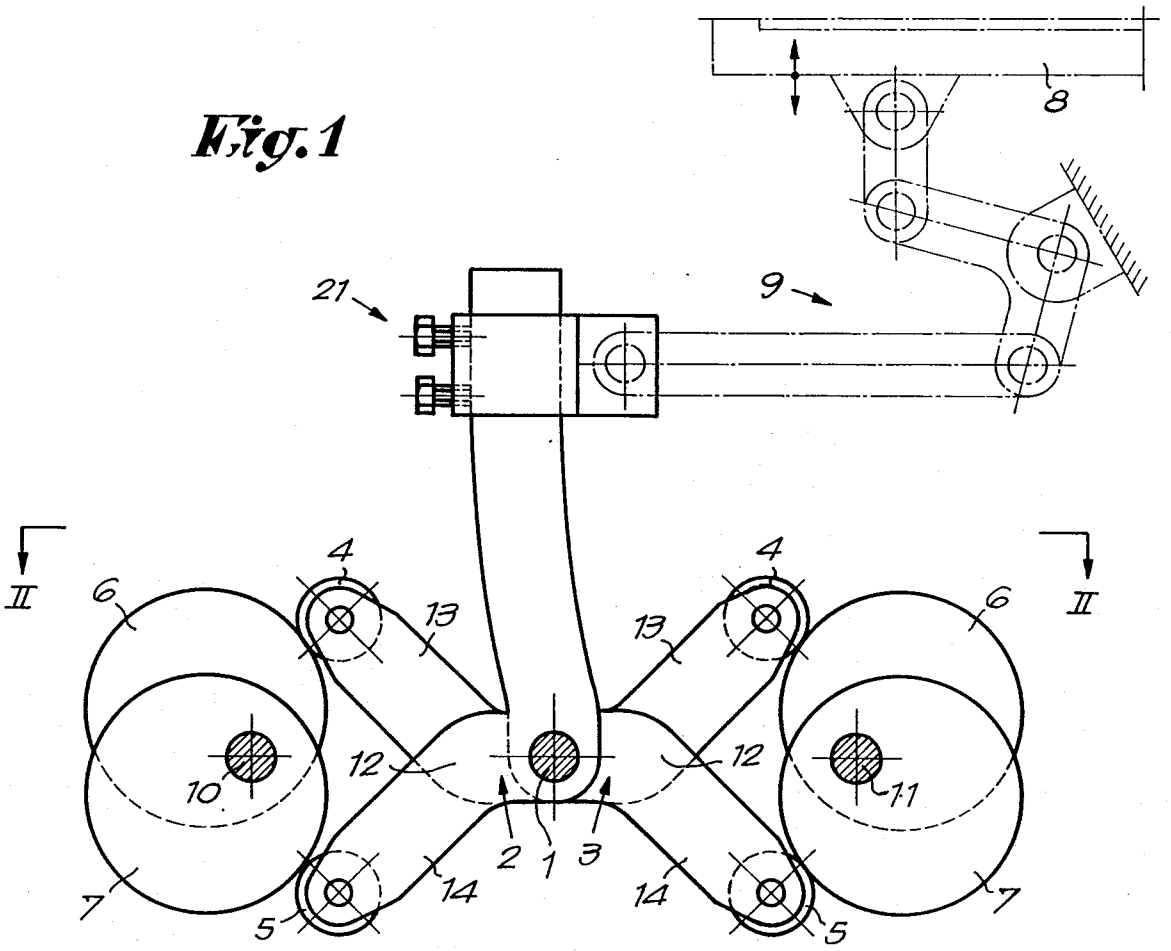
FIG. 1 shows a side view of an embodiment according to the invention.
Figure 2:
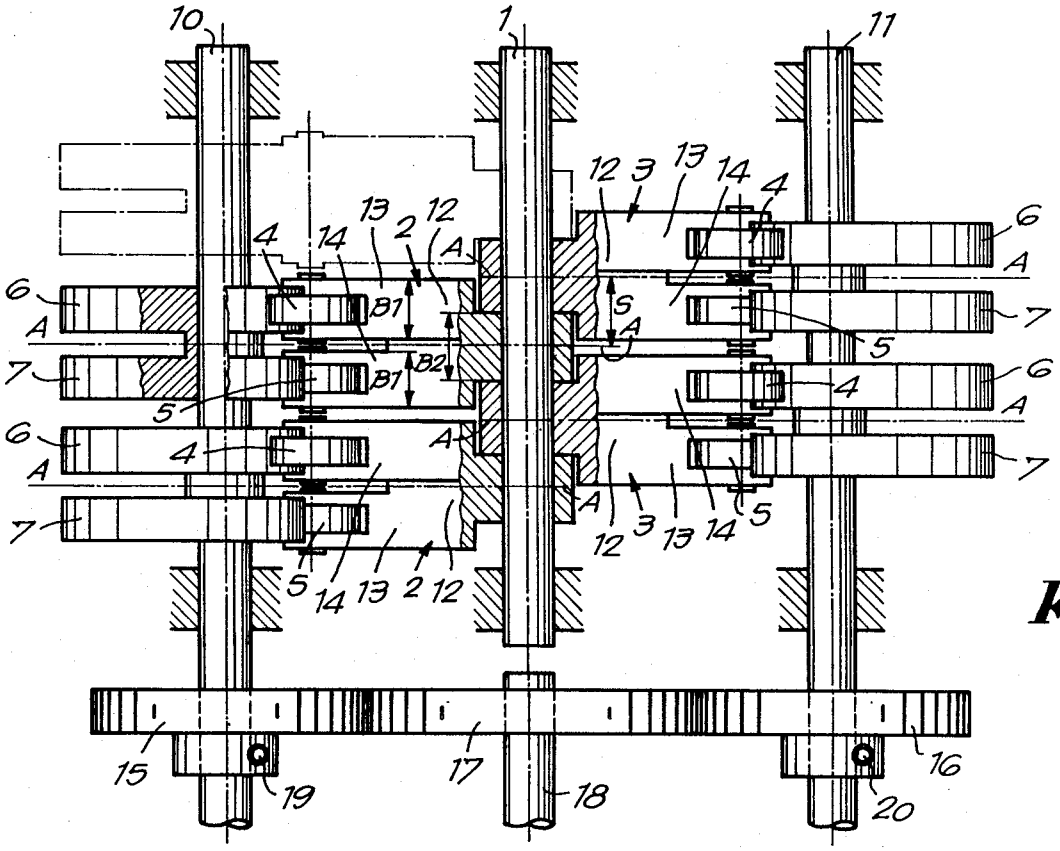
FIG. 2 is a top view taken along line II-II in FIG. 1.

As shown in the figures, the embodiment according to the invention includes pairs of levers 2 and 3, mounted respectively on a common shaft 1. Levers 2 and 3 are each fitted with two cam followers 4–5 operating with the cams 6–7, and are connected to a harness 8, for example by means of a lever transmission 9, such that driving the cams 6–7 causes the levers 2–3 to oscillate, in turn causing the up-and-down motion of the harnesses. Each pair of cams 6–7 and the accompanying cam followers 4–5 form positive cam drives for the levers 2–3.

According to the invention, the cam groups accompanying the levers 2–3 are distributed over at least two cam shafts 10 and 11 and the levers 2–3 are mounted alternately and in opposite senses in relation to each other.

At the common shaft 1 the levers 2–3 are mounted next to one another with a distance S between centers of the levers along the shaft. On the other hand, the opposite ends of each of the levers, including cam followers 4 and 5, have an effective width which is twice as wide as the above-mentioned distance S.

Thus, the alternating and opposing configuration ensures that the ends of the levers which follow cams 6 and 7 have a width which is approximately twice that of the width S occupied by each of the levers along the common shaft 1. This widening is designated by reference numeral 12, which divides into two parts 13 and 14 in which the cam followers 4–5 are mounted. The width B1 of these parts 13–14 may be almost equal to the width B2 of the levers 2–3 at the shaft 1 so that practically no loss of strength occurs. The cams 6 and 7 can be chosen to be relatively wide, thus limiting the wear.

The alternating and crosswise configuration also allows the parts 13 and 14 to be positioned symmetrically in relation to the middle area A—A of the lever concerned, thus keeping the torsion moments to a minimum.

The means for driving the cam shafts 10 and 11 include a gear train formed by gear wheels 15–16 on cam shafts 10–11 and an intermediate gear wheel 17 which is connected to the main drive of the weaving machine via shaft 18. According to a special embodiment each pair of cams 6–7 consists of one solid piece, thus eliminating the disadvantage of having to adjust the play, since the two matching cams 6–7 always remain in the correct position in relation to each other. This also allows the crossing moment of the harnesses to be changed simply by mounting the cam pairs at different angles on the cam shafts 10–11.

By adjusting the coupling between the cam shafts 10–11 over a certain angle, the relative motion of the harnesses which operate with the cam shaft 10 on the one hand and the harnesses which operate with the cam shaft 11 on the other can be adjusted, an operation known as "treadling". This adjustment can be carried out for example by changing the meshing of the gear wheels 15-16-17 in relation to each other or by turning the cam shafts 10 and/or 11 in relation to their gear wheels 15 and 16 and setting them in another position, by means of the appropriate adjusting devices, for example by means of screws 19–20.

It is clear that the transmissions 9 may contain adjusting devices 21 which allow the adjustment of the harnesses 8.

It is also clear that more than two cam shafts can be used. These cam shafts can be driven at different speeds, depending on the desired weave pattern.

The present invention is not limited to the embodiment described by way of example and shown in the drawings; on the contrary, it can be made in various forms and sizes, while still remaining within the scope of the invention.

I claim:

1. A device for driving harnesses of weaving machines, comprising:

at least two cam shafts;

means for driving said cam shafts;

on each cam shaft, at least one pair of conjugated cams connected to each other;

a common shaft;

two levers;

means for swivel-mounting said two levers on said common shaft, symmetrically opposite to each other in respect to a plane including said common shaft;

means including two cam followers mounted on ends of each lever which contact respective conjugated cams for providing a positive cam drive of the levers so that they carry out an oscillating motion; and transmission means for converting said oscillating motion of the levers into a linear motion of the harnesses.

2. A device as claimed in claim 1, wherein said lever mounting means further comprises means for mounting said levers on said common shaft as close to each other as possible without touching, and wherein said ends of said levers comprising said cam followers have a width, in a direction parallel to the shaft, which is approximately twice that of a distance between centers of said levers along the common shaft at intersections between said levers and said common shaft.

3. A device as claimed in claim 2 wherein said ends of said levers comprising said cam followers are divided into two parts each of which carries one of said cam followers, and wherein said lever mounting means comprises means for mounting said levers symmetrically with respect to a median plane in which said levers swivel.

4. A device as claimed in claim 1, wherein the number of said at least two cam shafts is two, and further comprising means for mounting said two cam shafts symmetrically in relation to said common shaft.

5. A device as claimed in claim 1, wherein each of said pair of conjugated cams is a single part.

6. A device as claimed in claim 5, further comprising means for mounting said cam pairs on their respective cam shaft, said cam pair mounting means including means for adjusting an angle of a cam in respect to its cam shaft.

7. A device as claimed in claim 1, further comprising means for adjusting an angular position of said cam shafts in relation to each other.

* * * * *